US007080508B2

(12) United States Patent
Stavale et al.

(10) Patent No.: US 7,080,508 B2
(45) Date of Patent: Jul. 25, 2006

(54) TORQUE CONTROLLED PUMP PROTECTION WITH MECHANICAL LOSS COMPENSATION

(75) Inventors: Anthony E. Stavale, Victor, NY (US); Nicolas W. Ganzon, Seneca Falls, NY (US); Daniel J. Kernan, Liverpool, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 21 days.

(21) Appl. No.: 10/846,946

(22) Filed: May 13, 2004

(65) Prior Publication Data

US 2005/0252205 A1 Nov. 17, 2005

(51) Int. Cl.
*F04B 49/00* (2006.01)

(52) U.S. Cl. ..... 60/431; 417/42; 417/44.1; 417/53; 417/63

(58) Field of Classification Search ..... 60/431, 60/445, 452; 415/30; 417/42, 44.1, 53, 417/63

See application file for complete search history.

(56) References Cited

U.S. PATENT DOCUMENTS 4,091,617 A * 5/1978 Cornell ..... 60/445
4,462,210 A * 7/1984 Pollman et al. ..... 60/445
4,470,092 A 9/1984 Lombardi
4,490,094 A * 12/1984 Gibbs ..... 417/53
4,707,139 A * 11/1987 Valenzky et al. ..... 366/77
4,827,197 A 5/1989 Giebeler
5,649,893 A 7/1997 Inaniwa et al.
5,726,881 A 3/1998 Inaniwa et al.
5,736,823 A 4/1998 Nordby et al.
5,742,522 A 4/1998 Yazici et al.
5,917,688 A 6/1999 Kido et al.
6,501,629 B1 12/2002 Marriott
6,679,820 B1 1/2004 Barkus et al.
6,933,693 B1 * 8/2005 Schuchmann ..... 417/44.1

* cited by examiner

*Primary Examiner*—Edward K. Look
*Assistant Examiner*—Michael Leslie

(57) ABSTRACT

A method and apparatus are provided for controlling the operation of a pump, such as a centrifugal pump, featuring steps of either adjusting the operation of the pump, or issues a warning to a user of the pump of an undesirable operating condition, or both, based on a comparison of an actual torque value and a corrected torque value either alone or in combination with a further step of compensating the corrected torque value based on a mechanical power offset correction. The corrected torque value may include a Best Efficiency Point (BEP) torque value and may also be compensated for based on at least the current operating speed of the pump. The pump has a controller for performing the steps of the method. The controller can compensate the corrected torque value based on the square of the speed change of the pump. The comparison may include a ratio of the actual torque value to the corrected torque value.

62 Claims, 7 Drawing Sheets

TORQUE CONTROLLED PUMP PROTECTION WITH POWER OFFSET

FIG.1A
FIG.1B

FIG.1: TORQUE CONTROLLED PUMP PROTECTION WITH POWER OFFSET

Torque at BEP and Torque Offset are calculated.

Default Values:
BEP Power – 90%of MOTOR NOMINAL POWER
BEP Speed – 100% OF MOTOR FL RPM
Power Offset – From Manufacturer's Literature Correction of BEP Torque ($T_{BEP}$) for current speed is made The actual torque is compared to the target BEP torque (corrected) as percentage of $T_{BEP(0)}$

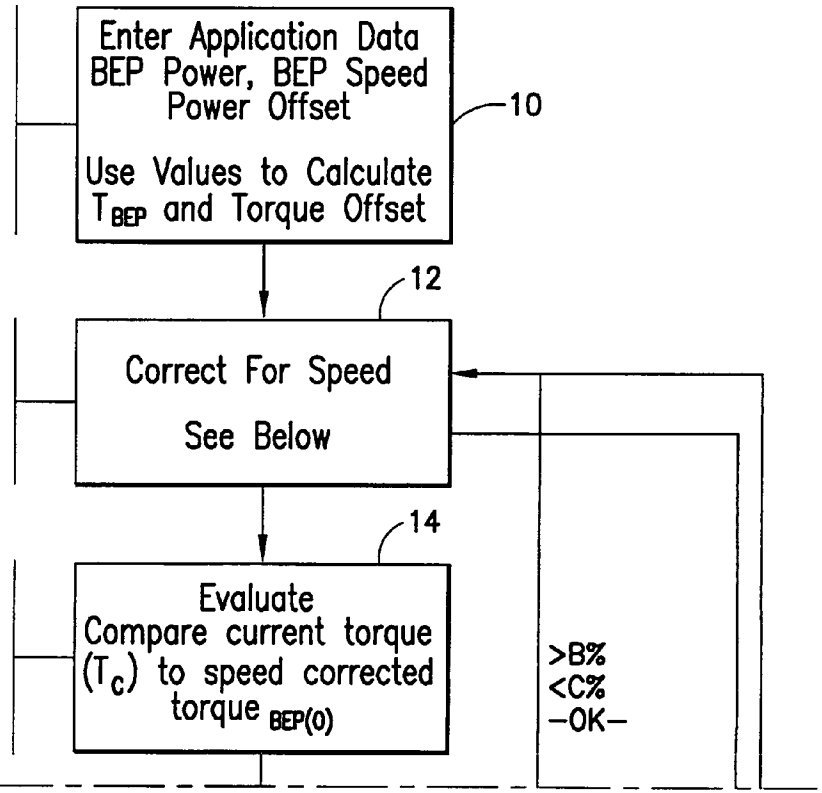

FIG.1A

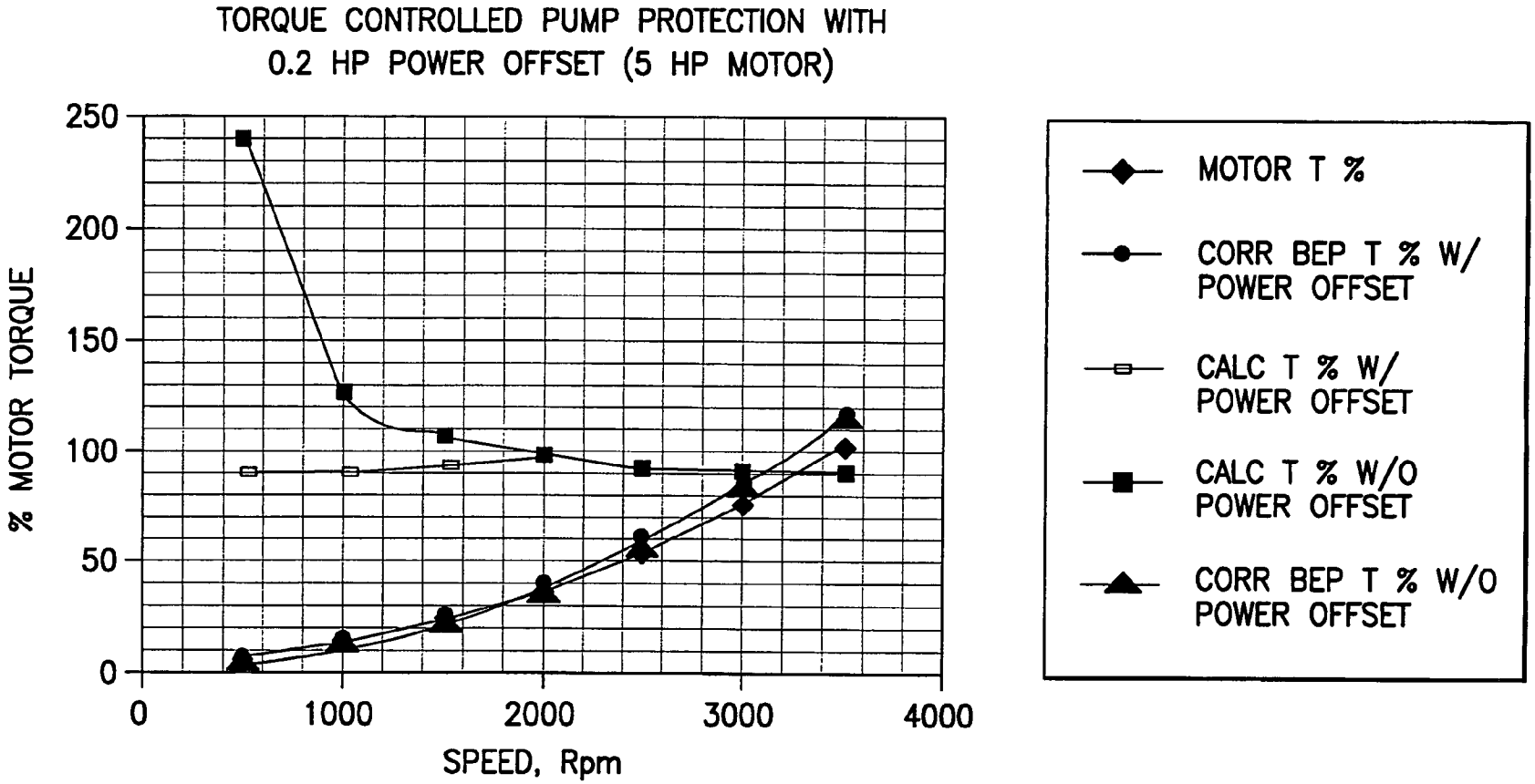
FIG.2A: POWER OFFSET COMPENSATION FOR SMALL HP MOTORS

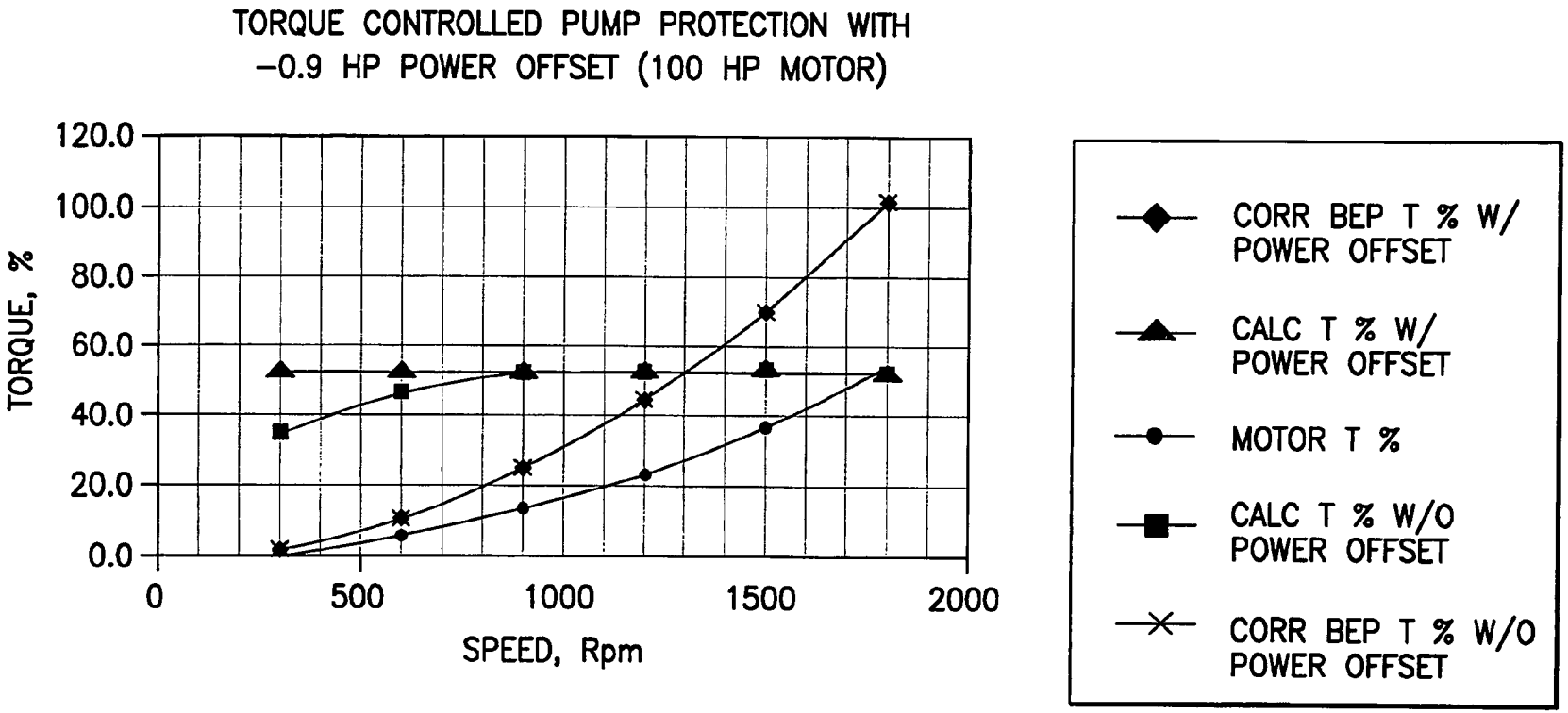
FIG.2B: POWER OFFSET COMPENSATION FOR LARGE HP MOTORS

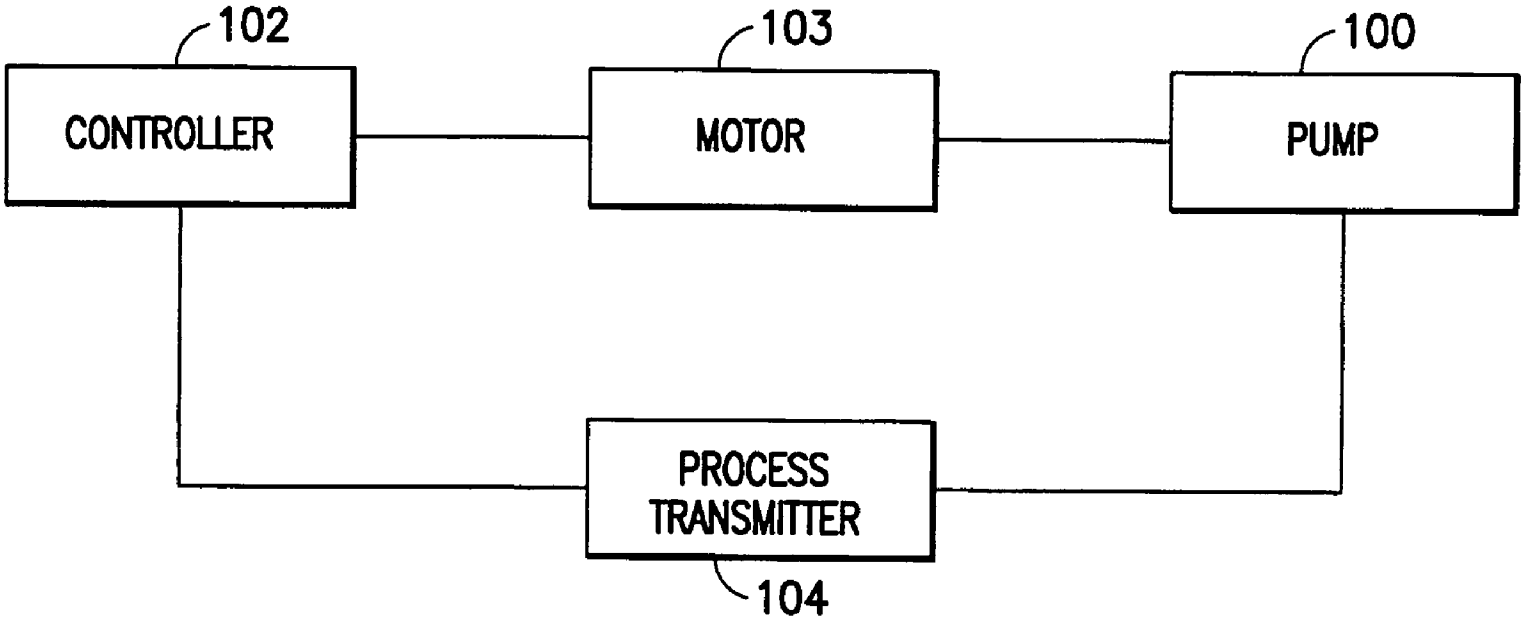
FIG.3: BLOCK DIAGRAM OF PUMP/MOTOR/CONTROLLER COMBINATION

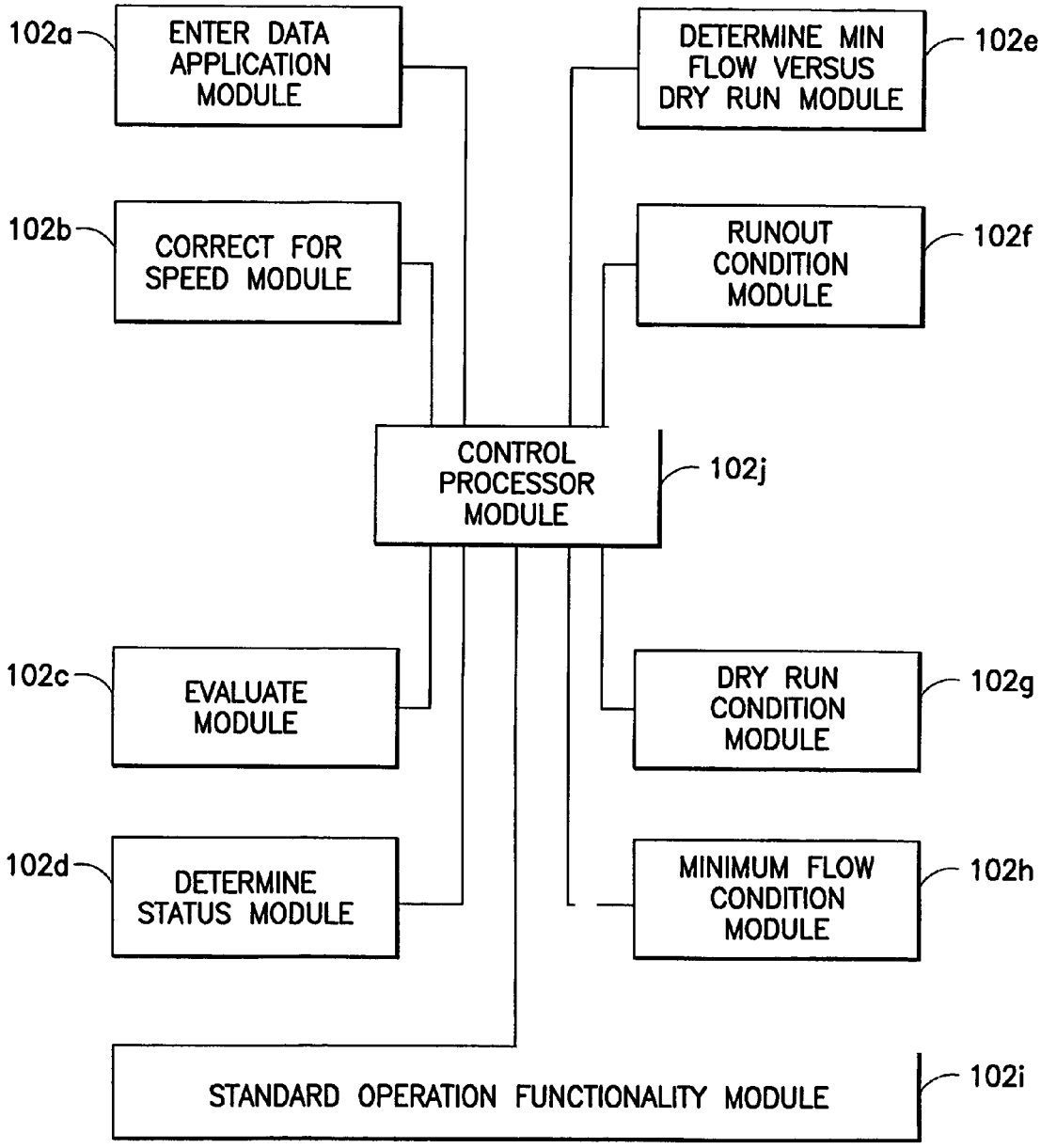
FIG.4: BLOCK DIAGRAM OF CONTROLLER FOR PROVIDING TORQUE CONTROLLED PUMP PROTECTION WITH POWER OFFSET

TORQUE CONTROLLED PUMP PROTECTION WITH MECHANICAL LOSS COMPENSATION

BACKGROUND OF THE INVENTION

1. Field of Invention

The present invention relates to a method and apparatus for controlling the operation of a pump, such as a centrifugal pump.

2. Description of Related Art

Many known Variable Frequency Drive (VFD) systems create accurate mathematical models of the motors being driven in order to provide precise control over speed and torque, which are used for controlling the operation of pumps. Such known methods and devices include the following:

U.S. Pat. No. 6,591,697 discloses a pump regulating technique based on a relationship of torque and speed versus the pump flow rate and the ability to regulate the pump flow using a Variable Frequency Drive (VFD) to adjust the centrifugal pump speed. However, this technique does not include logic that would provide for protection against undesirable operating conditions, such as a dry run condition, a minimum flow condition, a runout condition, or some combination thereof. Instead, this technique merely utilizes calibrated speed versus torque curves which are application specific to obtain flow thereby reducing flexibility during field setup.

U.S. Pat. No. 6,464,464 sets forth a control and pump protection algorithm which uses a VFD and auxiliary instrumentation to regulate flow, pressure or speed of a centrifugal pump, while other VFD systems utilize flow or pressure switches to identify undesired operating conditions. However, the use of additional process flow switches and other auxiliary instrumentation adds cost and complexity to the drive system, a potential failure point, and unnecessary cost.

U.S. Pat. Nos. 5,930,092 and 5,754,421 disclose pump protection techniques based on an observation of the motor amperage draw and speed and then a correlation of the resulting power reading to various operating conditions (e.g. dry running, closing valves). However, this technique is suitable only for constant speed applications and fails to provide control differentiation for various conditions; protective settings result in only "tripping" or shutting off of the motor.

Another known pump control technique is based on a VFD having parameters that allow maximum and minimum torque values to be configured to prevent the load driver (motor) from operating outside of these parameters. However, this drive technique does not provide logic for interpreting different undesirable operating conditions, nor does it allow for scaling of centrifugal loads, such as pumps or take into account mechanical losses in small pumps at reduced speed.

Other known ways for controlling the operation of pumps include the following: U.S. Pat. No. 4,470,092 discloses a motor protector that trips a motor based on a comparison of one or more sensed trip point parameters and programmed trip point parameters. U.S. Pat. No. 4,827,197 discloses a pump with overspeed protection that adjusts the pump speed based on sensed tachometer and current values, in which the torque is computed based on the sensed current value, an angular acceleration is computed based on the sensed tachometer value, inertia is computed based on the computed torque and angular acceleration, and a table lookup is used to provide a maximum speed of rotation.

U.S. Pat. No. 5,726,881 discloses a pump with overspeed protection that adjusts the pump speed based on two sensed rotational speeds detected by sensors. Similarly, see also U.S. Pat. No. 5,649,893 that discloses a pump with series-implemented protection means. U.S. Pat. No. 5,736,823 discloses a blower and motor combination with constant air flow control that adjusts torque of the motor based on sensed motor speed and current from sensor and flow rate inputs from flow rate input devices, in which speed, torque, pressure and air flow characteristics of the blower are used in making the torque calculation. U.S. Pat. No. 5,742,522 discloses a pump having a digital torque estimator that is used to detect load changes based on sensed current and voltage values with sensors. U.S. Pat. No. 5,917,688 discloses a pump with overspeed protection that adjusts the pump speed based on two sensed rotor and motor speed values detected by sensors. U.S. Pat. No. 6,501,629 discloses a motor with a controlled power line that adjusts the motor power based on sensed motor current and voltage values detected by sensors, in which a measured input power is compared to an input power limited range and the power is disconnected based on this comparison. U.S. Pat. No. 6,679,820 discloses a method for limiting the operational speed of a motor based on a collective evaluation using a method involving rotor and torque tables and including a step of determining an actual ratio of change in acceleration and difference in drag torque speed terms of a rotor in relation to a predetermined range of an expected ratio of change.

The above devices and techniques do not include logic that differentiates undesirable operating conditions to control the pump appropriately for each condition and there is a need in the prior art for controlling the operation of a pump that differentiates between undesirable operating conditions. In some cases auxiliary instrumentation and controls are required.

SUMMARY OF INVENTION

The present invention provides a new and unique method and apparatus for controlling the operation of a pump, such as a centrifugal pump, featuring steps of either adjusting the operation of the pump, or issuing a warning to a user of the pump of an undesirable operating condition, or both, based on a comparison of an actual torque value and a corrected torque value, either alone or in combination with a further step of compensating the corrected torque value based on a mechanical power offset correction.

The corrected torque value may include a Best Efficiency Point (BEP) torque value and may also be compensated for based on at least the current operating speed of the pump. The pump has a controller for performing the steps of the method. In one embodiment, the controller compensates the corrected torque value based on the square of the speed change of the pump. The comparison may include a ratio of the actual torque value to the corrected torque value, and the ratio of the actual torque value to the corrected torque value may also be compared to ratios corresponding to either a dry run condition, a minimum flow condition, a runout condition, or some combination thereof.

In operation, the controller detects and differentiates between different undesirable operating conditions, including either a dry run condition, a minimum flow condition, a runout condition, or some combination thereof, and controls the pump accordingly by either slowing the pump to a safe operating speed, shutting down the pump, re-starting the pump after a time delay, or some combination thereof. In the pump, a protection delay can also be set to avoid nuisance trips caused by system transients. The controller may include a variable frequency drive (VFD) or a programmable logic controller (PLC).

The present invention is implemented using control logic that utilizes the direct feedback of torque (or power) and speed to identify undesirable operating conditions and provide the appropriate operating response to protect the driven machine (centrifugal pump) from damage. The control logic can be embedded in the VFD or PLC.

In operation, the algorithm for the control logic compensates the original torque input data for the current operating speed according to the square of the speed change and compensates for mechanical losses, such as seal and bearing losses, which vary linearly with the speed change.

The invention also includes apparatus in the form of a centrifugal pump having such a controller for controlling the operation of the pump, wherein the controller either adjusts the operation of the pump, or warns a user of the pump, or both, based on a comparison of an actual torque value and a corrected torque value, as well as the controller itself for performing such steps.

The user can disable all of the aforementioned functionality of the pump at any time.

One advantage of the torque controlled pump protection technique with mechanical loss compensation, according to the present invention, is that it eliminates the need for auxiliary instrumentation and controls, such as a flow meter, pressure switch, flow switch etc.

Another advantage of the torque controlled pump protection technique, according to the present invention, is that it does not require expensive and complex auxiliary equipment, which may also be potential points of failure.

Moreover, the present invention also provides protection for centrifugal pumps while differentiating between dangerous operating conditions (e.g. dry running) and/or conditions where transient conditions (e.g. shut-off operation) may occur and the protection revoked once the condition clears.

Finally, the mechanical power offset correction adjusts the speed corrected torque values to extend the operating speed range for smaller and large hp units.

BRIEF DESCRIPTION OF THE DRAWING

The drawing, not drawn to scale, includes the following Figures:

FIG. 2A is a power offset compensation graph for a torque controlled pump protection with 0.2 HP Power Offset (5 HP Motor) having motor torque in relation to speed (RPMs).

FIG. 2B is a power offset compensation graph for a torque controlled pump protection with −0.9 HP Power Offset (100 HP Motor) having motor torque in relation to speed (RPMs).

FIG. 3 is a block diagram of a pump, motor and controller that is the subject matter of the present invention.

FIG. 4 is a block diagram of the controller shown in FIG. 3 for performing torque controlled pump protection with power offset that is the subject matter of the present invention.

DETAILED DESCRIPTION OF INVENTION

Figure 1B:
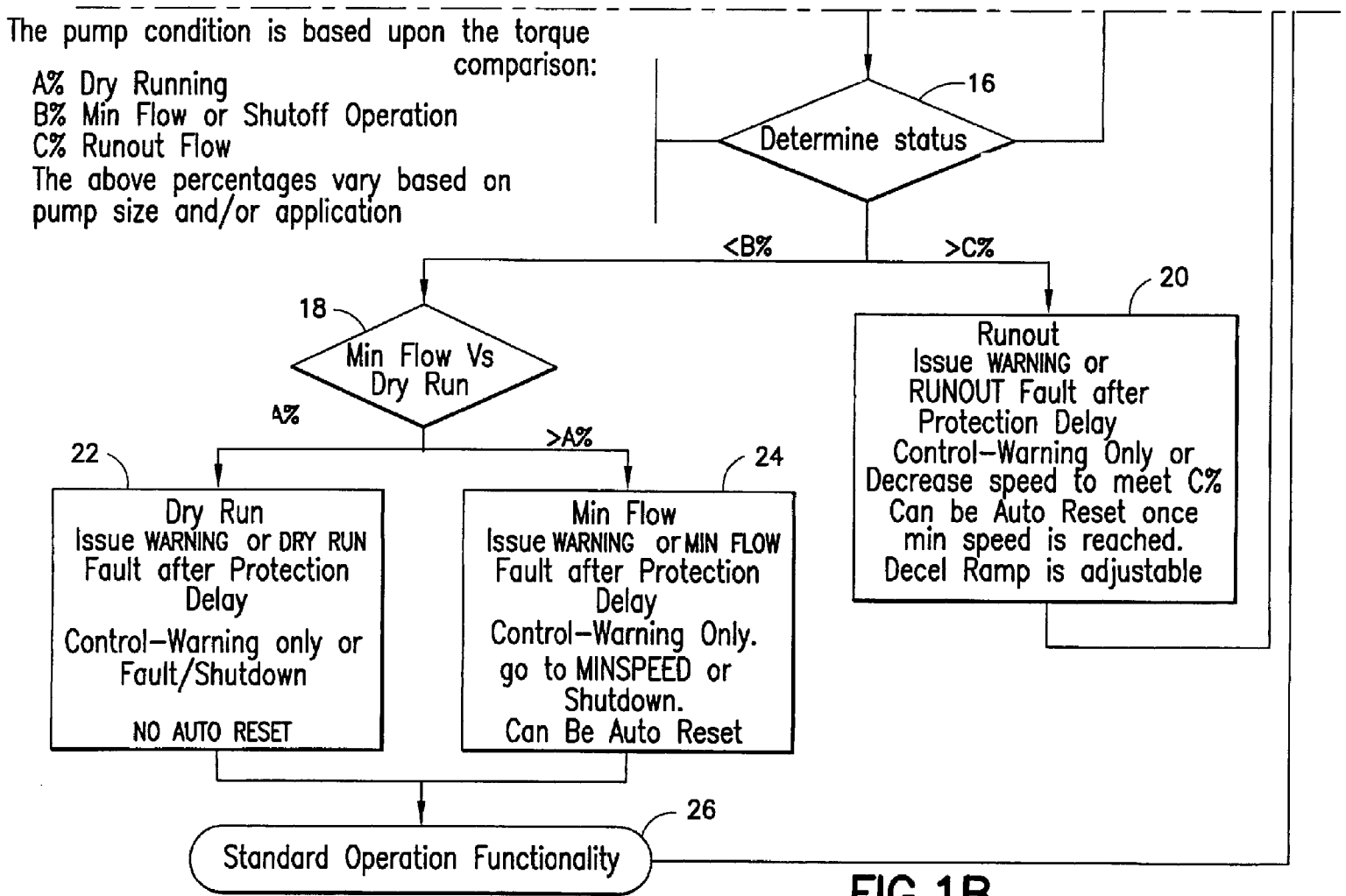
FIG. 1 is a flow chart of steps of a method for performing torque controlled pump protection that is the subject matter of the present invention.
Figure 5:
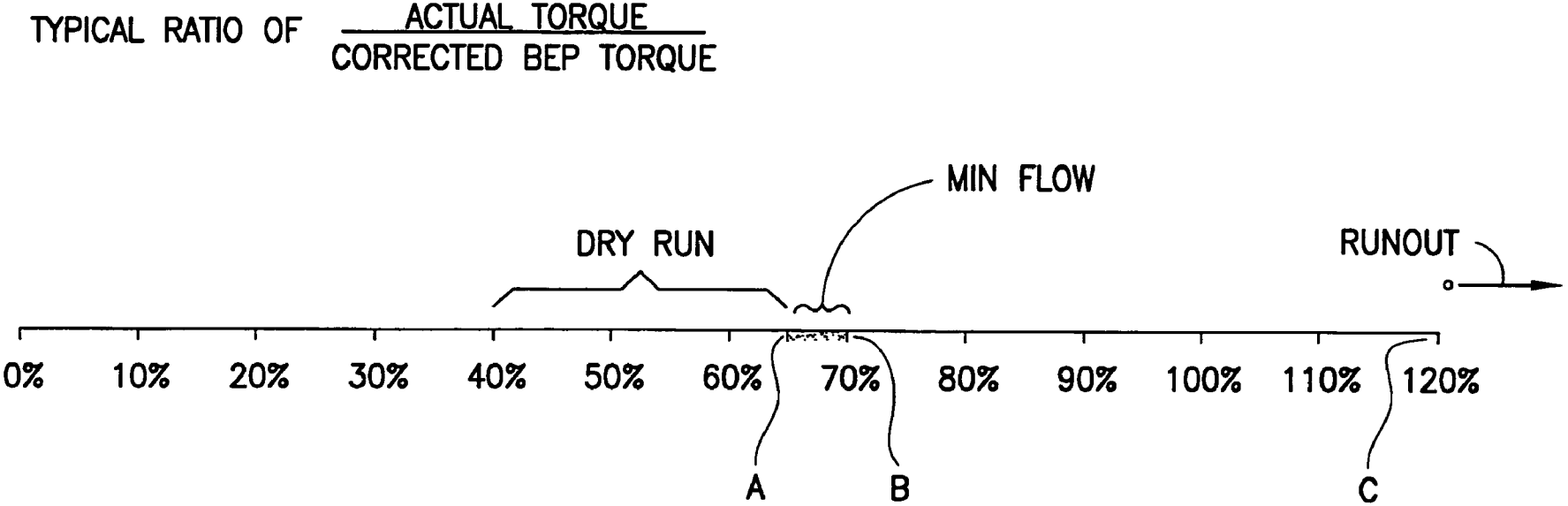
FIG. 5 is a line graph showing the pump conditions based on the ratio of the actual torque value to the corrected torque value.

FIG. 1 shows a flow chart having steps for performing a method according to the present invention for controlling the operation of a pump generally indicated as 100 (FIG. 3), featuring steps of either adjusting the operation of the pump 100, or issuing a warning to a user of the pump 100 of an undesirable operating condition, or both, based on a comparison of an actual torque value and a corrected torque value. The steps of the method are performed by a controller 102 of the pump 100 and motor 103 shown in FIGS. 3 and 4. The invention is described in relation to a pump, although the scope of the invention is intended to include a centrifugal pump or other centrifugal device, such as a blower, mixer or other suitable centrifugal device.

Step 10 for Entering Application Data

In operation, the controller 102 has an enter application data module 102*a* (FIG. 4) that first performs a step 10 for entering application data, including entering default values for the BEP power (90% of motor nominal power), BEP speed (100% of motor FL RPM) and a power offset typically from the pump manufacturer's literature. These default values are used to calculate the torque at the Best Efficiency Point (BEP) and the torque offset.

Alternatively, values different from the default values can be used for BEP power and BEP speed based on manufacturer's literature. The threshold values must be input during field setup for DRY RUN (A %), MIN FLOW (B %) and RUNOUT FLOW (C %) based on system operating conditions and pump performance data in order to differentiate between shut-off, dry running and run-out conditions. The algorithm set forth herein calculates and displays values of Calc Torque % and Corr BEP torque % at the current operating point to facilitate set-up of A, B and C %.

Step 12 for Correcting for Speed

The controller 102 has a correct for speed module 102*b* (FIG. 4) for performing a step 12 for making a correction of the BEP torque ($T_{BEP}$) for the current speed of the motor 103 (FIG. 3) and power offset compensation using the equations set forth below in relation to the description of FIGS. 2A and 2B.

Correction of BEP Torque ($T_{BEP}$) for Actual Speed Conditions with Power Offset In Step 12, the correction of the BEP torque ($T_{BEP}$) is made for actual speed conditions with the power offset. This correction is particularly important for pumps having small or large HP motors. See FIGS. 2A and 2B, in which FIG. 2A shows a power offset compensation graph for a torque controlled pump protection with 0.2 HP Power Offset (5 HP Motor), while FIG. 2B shows a power offset compensation graph for a torque controlled pump protection with −0.9 HP Power Offset (100 HP Motor).

The mechanical power offset correction adjusts the corrected BEP torque which is important for smaller HP units operating at lower speeds. As shown in FIG. 2A, the deviation between the Corrected (calculated) BEP Torque % w/o compensation for mechanical losses and Actual Motor Torque % is significant at low speeds. This is amplified in curves showing the Calc T % with and without compensation for power offset (mechanical losses). The power offset correction effectively extends the useable speed and application range. Ideally the Calc T % should be a horizontal line extending across the entire motor speed range for a constant system. Note without the power offset compensation the useable speed range of the application becomes limited. As shown in FIG. 2A, the present invention extends the operating range of a 5 hp 3600 rpm motor from 2400–3600 rpm (33% of speed range) without mechanical loss compensation to 500–3600 rpm (85%+ of the speed range) with mechanical loss compensation. This is more than a 150% improvement in the operating range. As shown, the curve for Calc Test Trq % without power offset rises considerably at lower speeds due to undercompensation of the Corr BEP Trq % value. As mentioned above for a constant system, the Calc Test Trq % value (Actual Torque/Corr Bep Trq %) should be a horizontal line since both of these torques theoretically vary according to the square of the speed change. However, testing has shown that at low speeds the square function is undercompensated due to mechanical losses in small pumps which vary linearly. This large increase in the Calc Test Trq % without power offset value would result in no protection for Dry Run and Min Flow conditions at speeds lower than 2400 rpm since the operating ratio becomes greater than the A or B % and false trips for Runout condition at speeds lower than 2400 rpm since the operating ratio becomes greater than the C %.

In contrast, FIG. 2B shows a chart with a slight negative power offset (−0.9% of nameplate power) which will extend the operating speed range of the torque based pump protection. The slight negative power offset is due to a slight overcompensation in the corrected BEP torque % calculation at low speeds. However, as shown, this has a pronounced effect in the Calc T % ratio (Actual motor torque/Corrected BEP torque). (Note, for the small HP motor previously discussed with respect to FIG. 2A, the correction was positive (+4% nameplate power) due to under compensation by seal and bearing mechanical losses.

As shown in FIG. 2B, the present invention extends the operating range of a 100 hp 1800 rpm motor from 900–1800 rpm (50% of speed range) without mechanical loss compensation to the tested 300–1800 rpm (83%+ of the speed range) with mechanical loss compensation. This is a 66% improvement in the operating range. As shown, the curve for Calc Test Trq % without power offset descends considerably at lower speeds due to a slight overcompensation of the Corr BEP Trq % value. For a constant system the CalcTest Trq % value (Actual Torque/Corr Bep Trq %) should be a horizontal line since both of these torques theoretically vary according to the square of the speed change. However, testing has shown that at low speeds the square function is not followed precisely. This results in a slight overcompensation for larger hp units. This large decrease in the Calc Test Trq % without power offset would result in false trips for Dry Run and Min Flow conditions at speeds lower than 900 rpm since the operating ratio becomes less than the A or B % and no protection for Runout condition at speeds lower than 900 rpm since the operating ratio becomes less than the C %.

To summarize, the power offset can compensate small and large HP motors to extend the operating speed range for torque based pump protection.

The algorithm set forth herein corrects the torque at BEP for actual operating speed and power offset based on the following equations.

For a speed range above 33% Motor FL Rpm (actual % may vary slightly by VFD manufacturer), the following equations are used:

$$\text{Corr Bep } T \text{ In-Lbs}=[[\text{Act Spd}/\text{Bep Spd}]^2\times[T\text{bep}-\text{Trq Offset}]]+[[\text{Act Spd}/\text{Bep Spd}]\times\text{Trq Offset}].$$

For a speed range below 33% Motor FL Rpm (actual % may vary slightly by VFD manufacturer), the following equations are used:

$$\text{Corr Bep } T \text{ In-Lbs}=[[\text{Act Spd}/\text{Bep Spd}]^2\times[T\text{bep}-\text{Trq Offset}]]+[\text{Trq Offset}], \text{ where:}$$

Bep Spd=pump speed, rpm, associated with the BEP Power. Default value=Motor Full Load Speed;

Bep Power=Power at current specific gravity, HP or Kw, Default value=90% of Motor Nominal Power;

Pwr Offset=Power, Hp or Kw (mechanical losses such as seals and bearings) (the values of these parameters are provided in the manufacturer's literature);

$T_C$=Current Motor Torque, in—lbs;

$$T\text{bep In-Lbs}=[[63025\times\text{Bep Power}]/\text{Bep Spd}] \text{ (Bep Power is in } HP);$$

$$T\text{bep In-Lbs}=[[63025\times[\text{Bep Power}/0.74569]]/\text{Bep Spd}] \text{ (Bep Power is in } Kw);$$

$$\text{Trq Offset In-Lbs}=[[63025\times\text{Pwr Offset}]/\text{Bep Spd}] \text{ (Pwr Offset is in } HP)$$

$$\text{Trq Offset In-lbs}=[[63025\times[\text{Pwr Offset}/0.74569]]/\text{Bep Spd}] \text{ (Pwr Offset is in } Kw)$$

Step 14 for Evaluating

The controller 102 has an evaluate module 102*c* (FIG. 4) for performing a step 14 for comparing the actual (or current) torque to a speed corrected torque ($T_{BEP(C)}$), which is a target BEP torque (corrected) as a percentage of the best efficiency point torque ($T_{BEP(C)}$).

Step 16 for Determining Status

The controller 102 has a determine status module 102*d* (FIG. 4) for performing a step 16 for determining the pump condition based upon the torque comparison, where A %: Running dry condition;

B %: Minimum flow or shutoff operation condition; and

C %: Runout flow condition.

These percentages are set as default values in the step 10 by the user and may vary or be varied based on the pump size and/or application. The scope of the invention is not intended to any particular percentage or percentages used to determine the status of the pump condition. As shown, if the torque comparison is greater than B % and less than C %, then the determine status module 102*d* determines the status of the pump to be O.K. and returns the controller 102 to step 12 for correcting for speed.

However, if the torque comparison is less than B % or greater than C %, then the determine status module 102*d* determines the status of the pump condition to be not O.K. and either in one case if the torque comparison is less than B % passed the controller to a step 18 for determining whether the pump condition is a MIN FLOW or DRY RUN condition, or in the other case if the torque comparison is greater than C % pass the controller 102 to a step 20 for controlling the operation of the pump 100 based on a RUNOUT condition.

RUNOUT Condition

In the case of the RUNOUT condition, the RUNOUT condition module 102*f* adjusts the operation of the pump 100, or issues a warning of the RUNOUT condition, or both. In particular, the RUNOUT condition module 102*f* can adjust the operation of the pump 100 by, for example, decreasing the speed of the pump to meet C % requirement. The RUNOUT condition module 102*f* can also auto reset the pump 100 once the minimum speed is reached. The deceleration ramp of the pump motor may be adjustable. The RUNOUT condition module 102*f* will perform the RUNOUT fault routine after a predetermined protection delay to avoid nuisance trips caused by system transients. After performing step 20, the RUNOUT condition module 102*f* returns the controller 102 to the step 12 for correcting for speed once the RUNOUT condition clears.

In effect, a RUNOUT protection condition is declared if the ratio of the Act Motor Torque/Corrected BEP Torque>C %. A typical setting is >120% of BEP Torque.

The reaction of the drive can be set to either warn the user with no further action taken or reduce speed enough so that the ratio of the Actual Motor Torque/Corrected BEP Torque=C %. The protection delay period can be set prior to declaring a RUNOUT condition. If the RUNOUT condition clears, the speed will be adjusted upward until the C % is reached or the original setpoint is achieved. The deceleration ramp during a RUNOUT condition can be adjusted by the user to suit the application. The drive can also be set to automatically reset a RUNOUT condition once the unit has reached minimum speed to check if the system transient condition has cleared. The number of resets and time between resets is adjustable by the user. Once the number of resets is exhausted, if the condition has not cleared, the unit will remain at minimum speed until action is taken by the user.

DRY RUN or MIN FLOW Conditions

The controller 102 has a DRY RUN or MIN FLOW condition module 102*e* that determines whether the pump is in a DRY RUN condition or a MIN FLOW condition based on the value of A %.

If the torque comparison is less than A %, then the DRY RUN or MIN FLOW condition module 102*e* pass the controller 102 to a step 22 for controlling the operation of the pump 100 based on a DRY RUN condition. In comparison, if the torque comparison is greater than A %, then the DRY RUN or MIN FLOW condition module 102*e* pass the controller 102 to a step 24 for controlling the operation of the pump 100 based on a MIN FLOW condition.

DRY RUN Condition

In the case of a DRY RUN condition (if the torque comparison is less than A %), then the controller 102 has a DRY RUN condition module 102*g* that determines in the step 22 the status of the pump to be not O.K., and either adjusts the operation of the pump 100, or issues a warning of the DRY RUN condition, or both.

In particular, the DRY RUN condition module 102*g* can adjust the operation of the pump 100 by, for example, shutting down the pump. Unlike the RUNOUT condition, the DRY RUN condition module 102*g* cannot auto reset the pump 100. Instead, the user must re-start the pump. The DRY RUN condition module 102*g* will perform the DRY RUN fault routine after a predetermined protection delay to avoid nuisance trips caused by system transients. After performing step 22, the DRY RUN condition module 102*g* passes the controller 102 to the step 26 for performing the standard operation functionality when done.

In effect, the DRY RUN protection condition is declared if the ratio of the Act Motor Torque/Corrected BEP Torque<A %. A typical setting is 40–65% of BEP Torque, although the scope of the invention is not intended to be limited to any particular percentage.

The reaction of the controller 102 is programmed to either warn the user with no further action taken or fault and shutdown the pump 100. A protection delay period can be set by the user in the initial set-up prior to declaring the DRY RUN condition. However, the controller 102 cannot be set to automatically reset a fault condition. Once the pump has faulted it will remain off until re-started by the user.

MIN FLOW Condition

In comparison, in the case of a MIN FLOW condition (if the torque comparison is greater than A %), then the controller 102 has a MIN FLOW condition module 102*h* that determines in the step 24 the status of the pump to be not O.K., and either adjusts the operation of the pump 100, or issues a warning of the MIN FLOW condition, or both.

In particular, the MIN FLOW condition module 102*h* can adjust the operation of the pump 100 by, for example, going to a minimum speed (MINSPEED) or shutting down the pump 100.

Similar to the RUNOUT condition, the MIN FLOW condition module 102*h* can auto reset the pump 100. The MIN FLOW condition module 102*h* will perform the MIN FLOW fault routine after a predetermined protection delay to avoid nuisance trips caused by system transients. After performing step 24, the MIN FLOW condition module 102*h* resumes the standard operation functionality in step 26 when done.

In effect, the MIN FLOW protection condition is declared if the ratio of the Act Motor Torque/Corrected BEP Torque<B % but >A %. A typical setting for the B % is 65–70% of BEP Torque, although the scope of the invention is not intended to be limited to any particular percentage.

The reaction of the controller 102 can be set to either warn the user with no further action taken, warn the user and slow down to a safe minimum operating speed (alarm & control) or fault and shutdown the unit. The protection delay period can be set prior to declaring a MIN FLOW condition. The controller 102 can also be set to automatically reset the alarm and control condition or fault to check if the system transient condition has cleared. The number of resets and time between resets is pre-set with default values in the initial set-up and adjustable by the user. Once the number of resets is exhausted, if the condition has not cleared, the pump will remain off until re-started by the user.

FIG. 4: The Controller 102

FIG. 4 shows the controller 102 in greater detail, including the various modules 102*a*, 102*b*, . . . , 102*i* discussed above. In addition, the controller 102 also includes a control processor module 102*j* for controlling the operation of the controller 102. The controller 102 also includes an input/output module (not shown) for receiving and sending data, including control data to control the operation of the pump 100.

In FIG. 4, the various modules 102*a*, 102*b*, . . . , 102*i*, 102*j* may be implemented using hardware, software, or a combination thereof. In a typical software implementation, one or more of the various modules 102*a*, 102*b*, . . . , 102*i*, 102*j* would be a microprocessor-based architecture having a microprocessor, a random access memory (RAM), a read only memory (ROM), input/output devices and control, data and address buses connecting the same. A person skilled in the art would be able to program such a microprocessor-based implementation to perform the functionality described herein without undue experimentation. The scope of the invention is not intended to be limited to any particular implementation of the various modules 102*a*, 102*b*, . . . , 102*i*, 102*j*.

Scope of the Invention

Accordingly, the invention comprises the features of construction, combination of elements, and arrangement of parts which will be exemplified in the construction hereinafter set forth.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense. For example, the scope of the invention is intended to include a method carried out using actual power values and speed corrected power at Best Efficiency Point (BEP). The invention has been shown and described herein using torque since many known Variable Frequency Drive (VFD) systems create accurate mathematical models of the motors being used to provide precise control over speed and torque.

In such an embodiment, power could then be inferred by these speed and torque values.

We claim:

1. A method for controlling the operation of a centrifugal pump, centrifugal blower, centrifugal mixer or centrifugal compressor characterized in that the method includes the steps of:

adjusting either the operation of the pump, or issuing a warning to a user of the pump of an undesirable operating condition, or both, based on a comparison of an actual torque value and a corrected torque value; and compensating the corrected torque value based on a mechanical power offset correction.

2. A method according to claim 1, wherein the corrected torque value is a best efficiency point (BEP) torque value.

3. A method according to claim 1, wherein the corrected torque value is compensated for based on at least the current operating speed of the pump.

4. A method according to claim 3, wherein the method includes the step of compensating the corrected torque value based on the square of the speed change of the pump.

5. A method according to claim 1, wherein the comparison includes a ratio of the actual torque value to the corrected torque value.

6. A method according to claim 5, wherein the ratio of the actual torque value to the corrected torque value is compared to ratios corresponding to either a dry run condition, a minimum flow condition, a runout condition, or some combination thereof.

7. A method according to claim 1, wherein the method includes the steps of detecting and differentiating between different undesirable operating conditions, including either a dry run condition, a minimum flow condition, a runout condition, or some combination thereof, and controlling the pump accordingly by either slowing the pump to a safe operating speed, shutting down the pump, re-starting the pump after a time delay, or some combination thereof.

8. A method according to claim 1, wherein the method includes the step of setting a protection delay to avoid nuisance trips caused by system transients.

9. A method according to claim 1, wherein the method includes performing the steps of the method with a controller that is either a variable frequency drive (VFD) or a programmable logic controller (PLC).

10. A centrifugal pump, centrifugal blower, centrifugal mixer or centrifugal compressor pump having a controller for controlling the operation of the pump characterized in that the controller either adjusts the operation of the pump, or issues a warning to a user of the pump of an undesirable operating condition, or both, based on a comparison of an actual torque value and a corrected torque value; and compensates the corrected torque value based on a mechanical power offset correction.

11. A pump according to claim 10, wherein the corrected torque value is a best efficiency point (BEP) torque value.

12. A pump according to claim 10, wherein the corrected torque value is compensated for based on at least the current operating speed of the pump.

13. A pump according to claim 12, wherein the controller compensates the corrected torque value based on the square of the speed change of the pump.

14. A pump according to claim 10, wherein the comparison includes a ratio of the actual torque value to the corrected torque value.

15. A pump according to claim 14, wherein the ratio of the actual torque value to the corrected torque value is compared to ratios corresponding to either a dry run condition, a minimum flow condition, a runout condition, or some combination thereof.

16. A pump according to claim 10, wherein the controller detects and differentiates between different undesirable operating conditions, including either a dry run condition, a minimum flow condition, a runout condition, or some combination thereof, and controls the pump accordingly by either slowing the pump to a safe operating speed, shutting down the pump, re-starting the pump after a time delay, or some combination thereof.

17. A pump according to claim 10, wherein a protection delay can be set to avoid nuisance trips caused by system transients.

18. A pump according to claim 10, wherein the controller is a variable frequency drive (VFD) or a programmable logic controller (PLC).

19. A controller for controlling the operation of a centrifugal pump, centrifugal blower, centrifugal mixer or centrifugal compressor, characterized in that the controller either adjusts the operation of the pump, or issues a warning to a user of the pump of an undesirable operating condition, or both, based on a comparison of an actual torque value and a corrected torque value; and compensates the corrected torque value based on a mechanical power offset correction.

20. A controller according to claim 19, wherein the corrected torque value is a best efficiency point (BEP) torque value.

21. A controller according to claim 19, wherein the corrected torque value is compensated for based on at least the current operating speed of the pump.

22. A controller according to claim 21, wherein the controller compensates the corrected torque value based on the square of the speed change of the pump.

23. A controller according to claim 19, wherein the comparison includes a ratio of the actual torque value to the corrected torque value.

24. A controller according to claim 23, wherein the ratio of the actual torque value to the corrected torque value is compared to ratios corresponding to either a dry run condition, a minimum flow condition, a runout condition, or some combination thereof.

25. A controller according to claim 19, wherein the controller detects and differentiates between different undesirable operating conditions, including either a dry run condition, a minimum flow condition, a runout condition, or some combination thereof, and controls the pump accordingly by either slowing the pump to a safe operating speed, shutting down the pump, re-starting the pump after a time delay, or some combination thereof.

26. A controller according to claim 19, wherein the controller sets a protection delay to avoid nuisance trips caused by system transients.

27. A controller according to claim 19, wherein the controller is a variable frequency drive (VFD) or a programmable logic controller (PLC).

28. A controller according to claim 19, wherein the controller includes an enter data application module for receiving default values for best efficiency point speed and power, as well as a default value for a power offset, and for calculating torque at a best efficiency point and a torque offset.

29. A controller according to claim 19, wherein the controller includes a correct for speed module for determining a correction of best efficiency point torque ($T_{BEP}$) for the current motor speed.

30. A controller according to claim 19, wherein the controller includes an evaluate module for comparing the actual torque value to the corrected torque value.

31. A controller according to claim 30, wherein the corrected torque value is a target BEP torque as a percentage of a best efficiency point torque ($T_{BEP(C)}$).

32. A controller according to claim 19, wherein the controller includes a determining status module that determines the undesirable operating condition based upon the comparison, including either a running dry condition, a minimum flow or shutoff operation condition, a runout flow condition, or some combination thereof.

33. A controller according to claim 32, wherein the determining status module determines the status of the pump to be O.K. and returns the controller to the step for correcting for speed if the comparison is greater than a second percentage (B %) and less than a third percentage (C %).

34. A controller according to claim 32, wherein the determine status module determines the status of the pump condition to be not O.K. if the comparison is less than a second percentage (B %) or greater than a third percentage (C %), then either in one case if the comparison is less than the second percentage (B %) passed the controller to a step for determining whether the pump condition is a MIN FLOW or DRY RUN condition, or in the other case if the comparison is greater than the third percentage (C %) passes the controller to a step for controlling the operation of the pump based on a RUN OUT condition.

35. A controller according to claim 19, wherein the controller includes a RUNOUT condition module that adjusts the operation of the pump, or issues a warning of the RUNOUT condition, or both.

36. A controller according to claim 35, wherein the RUNOUT condition module warns the user, adjusts the operation of the pump by decreasing the speed of the pump to meet C % requirement, auto resets the pump once a minimum speed is reached, performs a RUNOUT fault routine after a predetermined protection delay to avoid nuisance trips caused by system transients, or some combination thereof; and then returns the controller back to the step for correcting for speed when done.

37. A controller according to claim 19, wherein the controller includes a DRY RUN condition module that determines the status of the pump to be not O.K. and in a DRY RUN condition it the comparison is less than a first percentage (A %), and either adjusts the operation of the pump, or issues a warning of the DRY RUN condition, or both.

38. A controller according to claim 37, wherein the DRY RUN condition module warns the user with no further action or warns the user and adjusts the operation of the pump by shutting down the pump.

39. A controller according to claim 37, wherein the DRY RUN condition module performs the DRY RUN fault routine after a predetermined protection delay to avoid nuisance trips caused by system transients.

40. A controller according to claim 37, wherein the DRY RUN condition module passes the controller to a step for performing standard operation functionality for the pump.

41. A controller according to claim 37, wherein the controller has a MIN FLOW condition module that determines the status of the pump to be not O.K. and in a MIN FLOW condition if the comparison is greater than a first percentage (A %).

42. A controller according to claim 41, wherein the MIN FLOW condition module either adjusts the operation of the pump, or issues a warning of the MIN FLOW condition, or both.

43. A controller according to claim 41, wherein the MIN FLOW condition module warns the user, adjusts the operation of the pump by going to a minimum speed (MIN-SPEED) or shutting down the pump, auto resets the pump after a predetermined time period performs the MIN FLOW fault routine after a predetermined protection delay to avoid nuisance trips caused by system transients, or some combination thereof.

44. A controller according to claim 41, wherein the MIN FLOW condition module passes the controller to a step for performing standard operation functionality for the pump.

45. A centrifugal pump, centrifugal blower, centrifugal mixer or centrifugal compressor having a controller for controlling the operation of the pump characterized in that the controller either adjusts the operation of the pump, or issues a warning to a user of the pump of an undesirable operating condition, or both, based on a comparison of an actual torque value and a corrected torque value, where the corrected torque value is based on the current pump speed.

46. A pump according to claim 45, wherein the controller also compensates the corrected torque value based on a mechanical power off set correction.

47. A pump according to claim 45, wherein the corrected torque value is a best efficiency point (BEP) torque value.

48. A pump according to claim 45, wherein the corrected torque value is compensated for based on at least the current operating speed of the pump.

49. A pump according to claim 48, wherein the controller compensates the corrected torque value based on the square of the speed change of the pump.

50. A pump according to claim 45, wherein the comparison includes a ratio of the actual torque value to the corrected torque value.

51. A pump according to claim 48, wherein the ratio of the actual torque value to the corrected torque value is compared to ratios corresponding to either a dry run condition, a minimum flow condition, a runout condition, or some combination thereof.

52. A pump according to claim 45, wherein the controller detects and differentiates between different undesirable operating conditions, including either a dry run condition, a minimum flow condition, a runout condition, or some combination thereof, and controls the pump accordingly by either slowing the pump to a safe operating speed, shutting down the pump, restarting the pump after a time delay, or some combination thereof.

53. A pump according to claim 45, wherein a protection delay can be set to avoid nuisance trips caused by system transients.

54. A pump according to claim 45, wherein the controller is a variable frequency drive (VFD) or a programmable logic controller (PLC).

55. A pump according to claim 46, wherein the mechanical power offset correction is a negative mechanical power offset correction.

56. A pump according to claim 46, wherein the mechanical power offset correction is a positive mechanical power offset correction.

57. A device having a controller for controlling the operation of the device characterized in that the controller either adjusts the operation of the pump, or issues a warning to a user of the pump of an undesirable operating condition, or both, based on a comparison of an actual torque value and a corrected torque value; and compensating the corrected torque value based on a mechanical power offset correction.

58. A device according to claim 57, wherein the corrected torque value is a best efficiency point (BEP) torque value.

59. A device according to claim 57, wherein the corrected torque value is compensated for based on at least the current operating speed of the pump.

60. A device according to claim 57, wherein the controller compensates the corrected torque value based on the square of the speed change of the pump.

61. A device according to claim 57, wherein the comparison includes a ratio of the actual torque value to the corrected torque value.

62. A device according to claim 57, wherein the device is a centrifugal pump, centrifugal blower, centrifugal mixer or centrifugal compressor.

* * * * *

UNITED STATES PATENT AND TRADEMARK OFFICE

CERTIFICATE OF CORRECTION

PATENT NO. : 7,080,508 B2
APPLICATION NO. : 10/846946
DATED : July 25, 2006
INVENTOR(S) : Anthony E. Stavale, Nicolas W. Ganzon and Daniel J. Kernan It is certified that error appears in the above-identified patent and that said Letters Patent is hereby corrected as shown below:

In column 5, line 37 after “losses” --,-- should be inserted.

In column 12, line 13, claim 37, line 4 “it” should be --if--.

In column 12, line 41, claim 43, line 5 after “time” --,-- should be inserted.

Signed and Sealed this

Fourth Day of September, 2007

JON W. DUDAS
*Director of the United States Patent and Trademark Office*